US005306586A

United States Patent [19]

Pai et al.

[11] Patent Number: 5,306,586

[45] Date of Patent: Apr. 26, 1994

[54] DUAL LAYER SWITCH PHOTORECEPTOR STRUCTURES FOR DIGITAL IMAGING

[75] Inventors: Damodar M. Pai, Fairport; Andrew R. Melnyk, Rochester; Milan Stolka, Fairport, all of N.Y.

[73] Assignee: Xerox Corporation, Rochester, N.Y.

[21] Appl. No.: 926,088

[22] Filed: Aug. 6, 1992

[51] Int. Cl.[5] ..... G03G 15/02

[52] U.S. Cl. ..... 430/58; 430/59; 430/78; 430/79; 430/87; 430/88; 430/91; 430/94

[58] Field of Search ..... 430/58, 59, 78, 79, 430/87, 88, 91, 94

[56] References Cited

U.S. PATENT DOCUMENTS

| | | | |
|---|---|---|---|
| 3,121,006 | 2/1964 | Middleton et al. | 430/87 |
| 3,881,925 | 5/1975 | Uchida et al. | 96/1.8 |
| 3,994,994 | 11/1976 | Stolk | 260/877 |
| 4,265,990 | 5/1981 | Stolka et al. | 430/59 |
| 4,587,189 | 5/1986 | Hor et al. | 430/59 |
| 4,618,551 | 10/1986 | Stolka et al. | 430/58 |
| 4,654,284 | 3/1987 | Yu et al. | 430/59 |
| 4,771,133 | 9/1988 | Liebesmann et al. | 540/143 |
| 4,806,444 | 2/1989 | Yanus et al. | 430/59 |
| 4,840,860 | 6/1989 | Staudemayer et al. | 430/59 |
| 4,840,861 | 6/1989 | Staudenmayer et al. | 430/59 |

*Primary Examiner*—John Kight, III
*Assistant Examiner*—John M. Cooney, Jr.
*Attorney, Agent, or Firm*—Kenyon & Kenyon

[57] ABSTRACT

An electrophotographic imaging member including a charge generating layer and a heterogeneous charge transport layer, the charge transport layer having regions of charge transport and inactive regions and the charge transporting regions are in contact with each other. This imaging member has characteristics that enable high quality and high contrast imaging.

28 Claims, 5 Drawing Sheets

Figure 1. Generation limited photodischarge.

Figure 2. S shaped, transport limited photodischarge.

DUAL LAYER SWITCH PHOTORECEPTOR STRUCTURES FOR DIGITAL IMAGING

BACKGROUND OF THE INVENTION

This invention relates to electrophotographic imaging members and more specifically, to imaging members having characteristics that enable high quality and high contrast imaging.

Electrophotographic photoreceptors typically include a photoconductive layer formed on a conductive substrate. The photoconductive layer is a good insulator in the dark so that electric charges can be retained on its surface. But upon exposure to light the charge is dissipated.

A latent image is formed on the photoreceptor by first uniformly depositing electric charges over the surface of the photoconductive layer by a conventional means. The photoconductive layer acts as a charge storage capacitor with charge on its free surface and an equal charge of opposite polarity (the counter charge) on the conductive substrate. A light image is then projected onto the photoconductive layer. On those portions of the photoconductive layer that are exposed to light, the electric charge is conducted through the layer reducing the surface charge. The portions of the photoconductive surface not exposed to light retain their surface charge. The quantity of electric charge at any particular area of the photoconductive surface is inversely related to the illumination incident thereon, thus forming a latent electrostatic image.

The photodischarge of the photoconductive layer requires the layer to photogenerate conductive charge and to transport this charge through the layer thereby neutralizing the charge on the surface. Two types of photoreceptor structures have been employed: Multilayer structures wherein separate layers perform the functions of charge generation and charge transport, respectively, and single layer photoconductors which perform both functions. These layers are laminated onto a conducting substrate and may include an optional charge blocking and an adhesive layer between the conducting and the photoconducting layers. Additionally, they may contain protective overcoatings and the substrate may consist of a non-conducting mechanical support with a conductive layer. Other layers to provide special functions such as incoherent reflection of laser light, dot patterns for pictorial imaging or subbing layers to provide chemical sealing and/or a smooth coating surface may be employed.

One common type of photoreceptor is a multilayered device that comprises a conductive layer, a blocking layer, an adhesive layer, a charge generating layer, and a charge transport layer. The charge transport layer can contain an active aromatic diamine molecule, which enables charge transport, dissolved or molecularly dispersed in a film forming binder. This type of charge transport layer is described, for example in U.S. Pat. No. 4,265,990. Other charge transport molecules disclosed in the prior art include a variety of electron donor, aromatic amines, oxadiazoles, oxazoles, hydrazones and stilbenes for hole transport and electron acceptor molecules for electron transport. Other charge transport layers have been developed that employ a charge transporting polymer wherein the charge transporting moiety is incorporated in the polymer as a pendant or in the chain or may form the backbone of the polymer. This type of charge transport polymer includes materials such as poly N-vinylcarbazole), polysilylenes, and others including those described in U.S. Pat. Nos. 4,618,551, 4,806,443, 4,806,444, 4,818,650, 4,935,487, and 4,956,440.

Charge generator layers employed include amorphous films of selenium and alloys of selenium and arsenic, tellurium, germanium and the like, hydrogenetated amorphous silicon and compounds of silicon and germanium, carbon, oxygen, nitrogen and the like, fabricated by vacuum evaporation or deposition, inorganic pigments of crystalline selenium and its alloys, III-V and II-VI compounds and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating.

Phthalocyanines have been employed as photogenerating materials for use in laser printers with infrared exposures. Infra red sensitivity is required for low cost semiconductor laser diodes used as the light exposure source. The absorption spectrum and photosensitivity depend on the central metal atom. Many metal phthalocyanines have been reported and include, oxyvanadium phthalocyanine, chloroaluminum phthalocyanine, copper phthalocyanine, oxytitanium phthalocyanine, chlorogallium phthalocyanine, magnesium phthalocyanine and metal-free phthalocyanine. The phthalocyanines exist in many crystal forms which have a strong influence on photogeneration.

Single layer photoreceptors commonly employed include photoconducting layers laminated onto a conducting substrate and may also include an optional charge blocking and/or an adhesive layer between the conducting and the photoconducting layers. The photoconducting layer materials include amorphous selenium and alloys of selenium and arsenic, tellurium, germanium and the like, hydrogenetated amorphous silicon and compounds of silicon and germanium, carbon, oxygen nitrogen and the like fabricated by vacuum evaporation or deposition, inorganic pigments of crystalline selenium and its alloys, II-VI crystals such as ZnO, CdS, III-V pigments and the like and organic pigments such as quinacridones, polycyclic pigments such as dibromo anthanthrone pigments, perylene and perinone diamines, polynuclear aromatic quinones, azo pigments including bis-, tris- and tetrakis-azos, metal phthalocyanines and the like dispersed in a film forming polymeric binder fabricated by solvent coating. Other organic photoconductor materials are electron donor and acceptor charge transfer systems such as polyvinyl-carbazole (PVK), 2,4,7-trinitro-9-fluorenone (TNF) and the like. The pure pigment photoconducting layers, such as amorphous selenium and silicon, both photogenerate and transport a charge. But when the pigment in is a binder layer, charge transport may take place entirely within the pigment while the binder is substantially insulating, as for example in the ZnO photoreceptor. Alternatively, charge transport may occur in a binder which is either (a) an insulating polymer doped with (i) an electron donor or (ii) acceptor molecules or (b) a charge transporting polymer as described above.

Charge generation controls the discharge (both photo and dark) of all the dual layer and nearly all the single layer photoreceptors. Restated, the amount of charge neutralized, as measured by the voltage across the photoconducting layers, is proportional to the light exposure (e.g., ergs/cm$^2$). The photodischarge curve is linear with a negative slope from the maximum (dark or zero exposure) voltage to the minimum voltage. The minimum voltage is referred to as the residual voltage. Light exposure beyond that required to reach the residual voltage does not produce any further discharge. In such photogeneration limited discharge, the ideal discharge is a linear discharge down to zero (residual) voltage with the slope being a measure of the photosensitivity. However, because the photogeneration rate in practical materials is electric field dependent, and decreasing with field, the discharge slope decreases and the discharge curve at low voltages increasingly departs from the linear discharge, requiring increasingly more light exposure to the same voltage discharge, as shown in FIG. 1. Because dark discharge, which is undesirable, also is generation limited, albeit thermal generation limited, dark discharge has the same electric field dependence, being high at high voltages (electric fields) and low at low voltages (electric fields).

Generation limited discharge is undesirable because it contributes to undesirable image quality variation through variations in electricals, that is, the voltages on the photoreceptor. Highest image quality in a xerographic system requires the voltages corresponding to the same image density or white background be constant, both spatially across the entire copy or print and temporally (or cyclically) from print to print. The generation limited discharge contributes to electrical variation in two ways. First, small variations at low light exposure result in large variations in the high (dark) voltage. Secondly, small variations in thermal generation also cause variation in the high (dark) voltage. The previous solutions have been to improve the materials and coating technologies to reduce the electrical variation of photoreceptors and improve the optics and electrical controls in the xerographic imaging machines.

Digital imaging provides an improvement in image quality. Digital systems have been used where gray or tone scales are produced by area coverage at constant local image density. Thus it is desirable to have a discharge curve (both photo and dark discharge if possible) that appears as a switch, with negligible voltage discharge until a critical exposure is reached, followed by complete discharge to residual voltage. This type of discharge is called S shaped hereinafter, as shown in FIG. 2. Such a binary discharge curve permits variation in both the off (or dark) and on (or fully exposed) light exposure with negligible voltage variation. Additionally, dark charge generation does not cause a dark voltage variation contributing to stable electricals.

One approach is to fabricate a single-layer, heterogeneous, particle-contact device in which photoconductor pigments are dispersed in insulating binders. The concentration of the charge generating and transporting pigment particles is high enough to maintain particle contact and thus a conducting path through the layer.

The key to an S shaped photodischarge curve is a heterogeneous structure which provides a connected but convoluted path for charge transport or conduction. At high electric fields, after the sample is charged, any charge generated at the surface is directed in a straight line through the layer, encounters a barrier in the insulating region and hence causes negligible voltage discharge. After nearly all the surface charge is injected, the local electric field normal to the surface is negligible and the remaining charge is able to move in other directions and follow the connected path to a depth below where the initial charge was stopped. At this deeper level the charge again sees the full electric field and encounters the insulating barrier. But because the motion of the previous charge reduced the electric field in the first level, more charge follows the convoluted path down to the next level. Thus by such a cascade total discharge occurs after a light exposure corresponding to the generation of enough charge required for total discharge, resulting in a step-like or S shaped discharge curve. By a similar argument, the dark discharge also has an S shaped time dependence, enabling very stable dark potentials.

The earliest such devise with an S shaped photodischarge curve is the single layer ZnO electrophotographic layer.

Another single layer device with S shaped photodischarge is described by J. W. Weigl et al. in "Current Problems in Electrophotography", pages 286–300, edited by W. F. Berg and K. Hauffe and published by Walter de Gruyter, Berlin in 1972. The layers consist of microcrystalline dispersions of X-metal free phthalocyanine in suitable binders. The X-metal free phthalocyanine, which are observed as needle like crystals, provides both the photogeneration and the hole transport in this device.

Another single layer particle contact device is discussed in articles "An aggregate Organic Photoconductor Part 1 and 2" by Dullmage et al. and Borsenberger et al. and is published in the Journal of Applied Physics, Vol 4, pages 5555–5564, 1978. The device described is a two phase aggregate photoconductor containing a co-crystalline phase of a thiopyrylium dye and a polycarbonate polymer in an amorphous phase of a triphenylmethane derivative in polycarbonate. An S shaped discharge shape is observed when the device is charged negatively and discharged by highly absorbed light. When charged positively, the normal generation limited discharge is observed. The photogeneration is attributed to the thiopyrylium and the discharge proceeds by hole transport through the amorphous phase of the triphenylmethane hole transport molecules in polycarbonate. When charged negatively, the discharge proceeds by electron transport through the co-crystalline phase, which form a dendritic network.

In the prior art, the S shaped discharge is observed in single layer devices which suffer from inflexibility in design. The same material, a pigment, is employed to photogenerate and transport the charge.

It is, therefore, an object of the present invention to provide an improved electrophotographic imaging member which overcomes the above noted disadvantages.

It is another object of the present invention to provide an electrophotographic imaging member whose discharge shape is controlled by the heterogeneous properties of the transport layer.

It is still another object of the present invention to provide an electrophotographic imaging member which exhibits an S shaped, high contrast discharge in a multi layer photoconductor.

It is still another object of this invention to provide a multilayer photoreceptor in which the transport layer has a structure in which charge transporting regions are surrounded by non-transporting regions and the charge transporting regions are in contact with each other, forming a convoluted path across the layer.

BRIEF DESCRIPTION OF THE THE FIGURES

SUMMARY OF THE INVENTION

Figure 1:
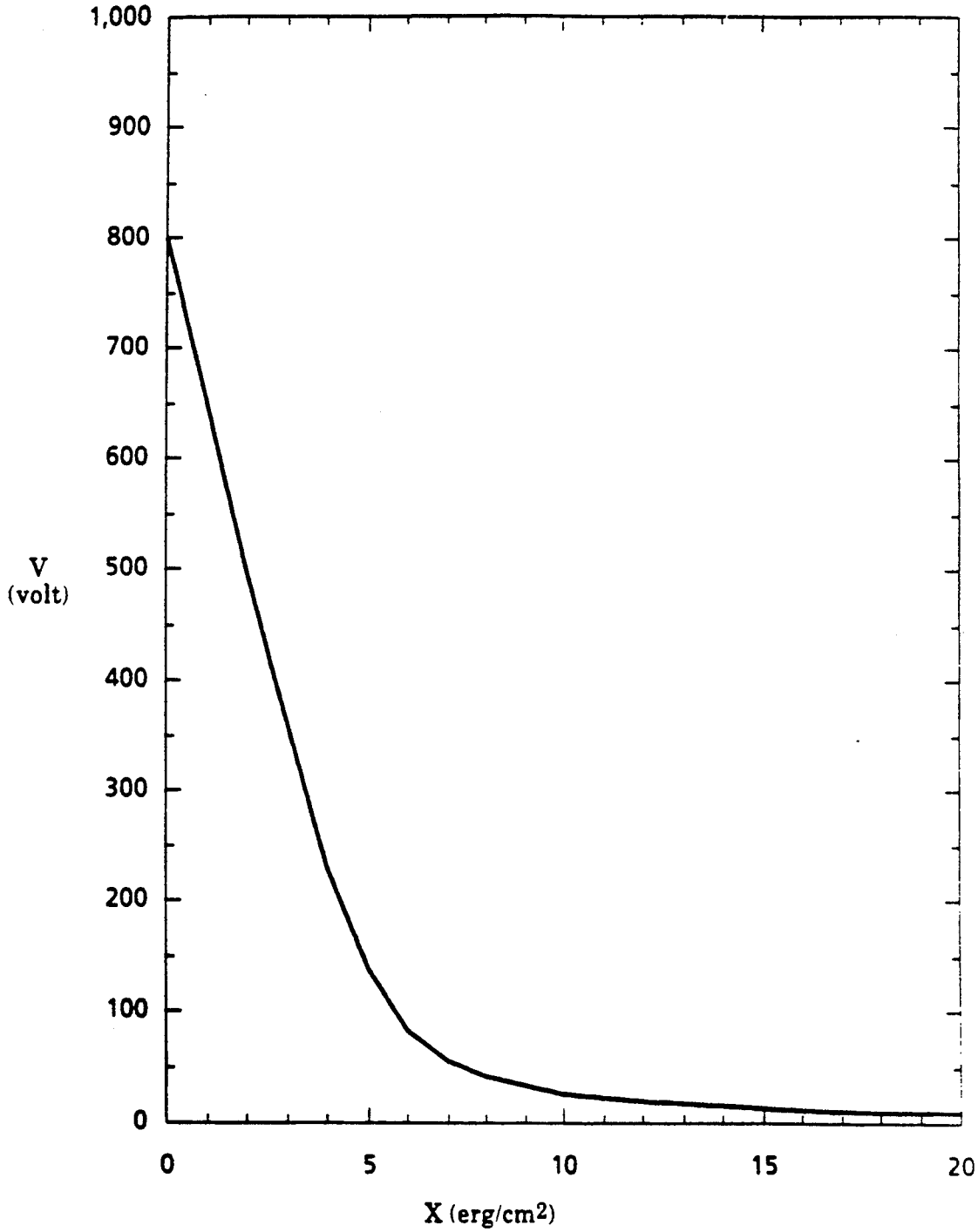
FIG. 1 shows the relationship between voltage and energy during generation limited photodischarge.
Figure 2:
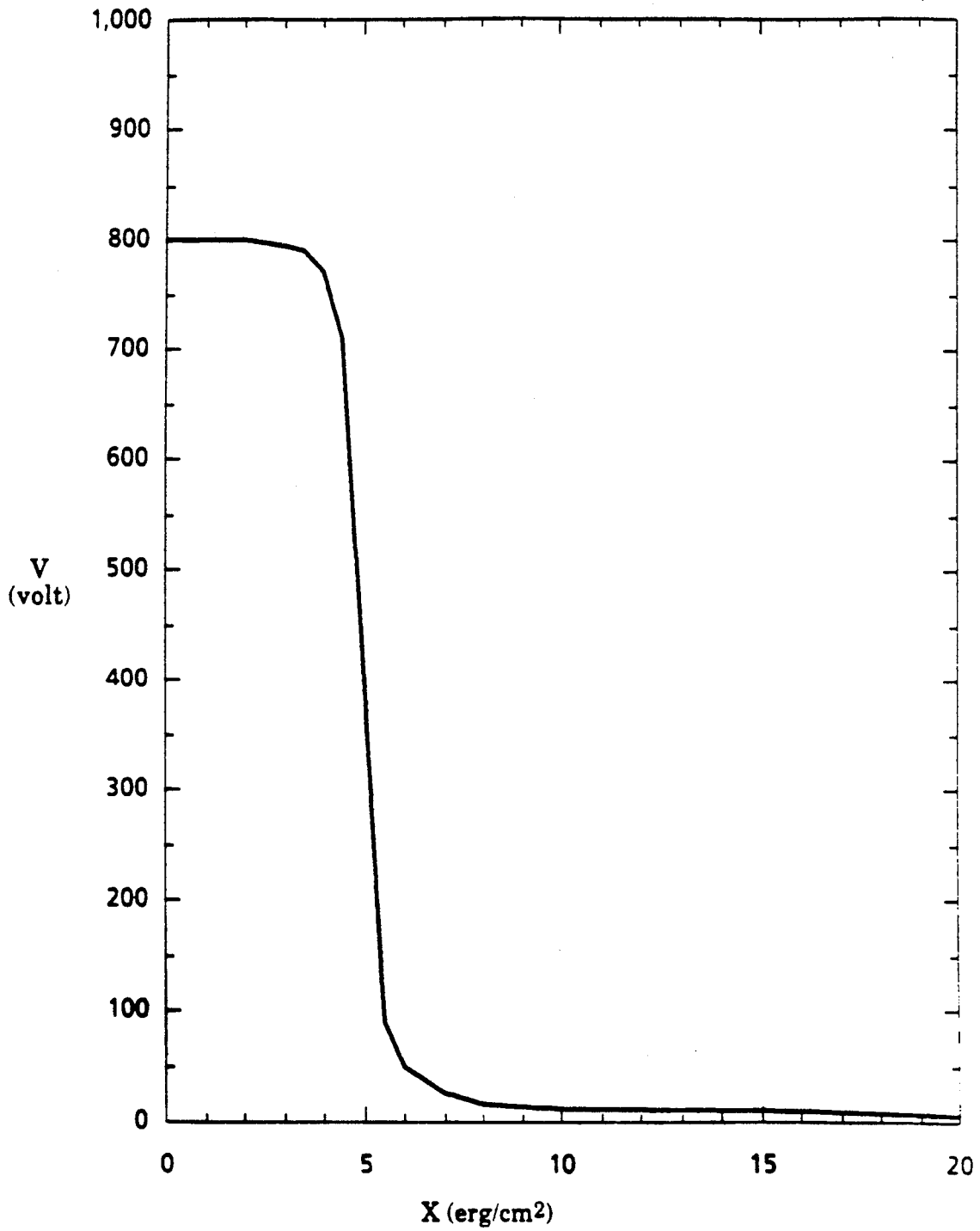
FIG. 2 is a binary discharge curve.

This shortcoming is eliminated in the design proposed in the present invention in which the generation step is separated from the transport step by employing two distinct materials for generation and transport.

The foregoing objects and others are accomplished in accordance with this invention by providing an electrophotographic imaging member comprising a generator layer and a charge transport layer. The charge transport layer comprises regions of charge transport surrounded by other regions that do not transport charge, or are inactive, and the regions of charge transport are in contact with each other. This can be accomplished by fabricating a heterogeneous charge transport layer in which inorganic or organic particles or crystallites capable of charge transport in contact with each other are immersed in an insulating polymer. A charge non-transporting or insulating binder is required to fabricate the particle contact charge transport layer. The particular structure of the transport layer can also be accomplished by fabricating the transport layer from a solid solution of a charge transporting molecules in a polymer binder and phase separating the two materials by, for example, crystallizing one of the phases, or employing a block copolymer in which charge transporting blocks are surrounded by non-transporting blocks. The device may include optional charge blocking, adhesive and subbing layers.

Electrophotographic imaging members are well known in the art. Electrophotographic imaging members may be prepared by various suitable techniques. Typically, a flexible or rigid substrate is provided having an electrically conductive surface. A charge generating layer is then applied to the electrically conductive surface. A charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top or below the charge transport layer.

The substrate may be opaque or substantially transparent and may comprise numerous suitable materials having the required mechanical properties. Accordingly, the substrate may comprise a layer of an electrically non-conductive, or conductive, material such as an inorganic or an organic composition. As electrically non-conducting materials. Various resins, including polyesters, polycarbonates, polyamides, polyurethanes, and the like which are flexible as thin webs, may be employed as electrically nonconducting materials. Any metal, for example, aluminum, nickel, steel, copper, and the like or a polymeric material described above, filled with a conducting substance, such as carbon, metallic powder, and the like or an organic conducting material may be used as electrically conducting substrate. The electrically insulating, or conductive, substrate may be in the form of an endless flexible belt, a web, a rigid cylinder, a sheet and the like.

The thickness of the substrate layer depends on numerous factors, including strength desired and economical considerations. Thus, a drum layer may be from less than a millimeter to centimeters in thickness. Similarly, a flexible belt may be less than 50 micrometers to about 250 micrometers, provided there are no adverse effects on the final electrophotographic device.

The substrate layers surface is preferably cleaned prior to coating to promote greater adhesion of the deposited coating. Cleaning may be effected, for example, by exposing the substrate layer surface to plasma discharge, ion bombardment, solvents, etchents and the like.

If a non-conductive substrate layer is used, one must also use a separate electrically conductive layer. The conductive layer may vary in thickness over substantially wide ranges depending on the optical transparency, degree of flexibility desired for the member and economic factors. Accordingly, for a flexible photoresponsive imaging device, the thickness of the conductive layer may be between about 20 angstroms to about 750 angstroms, and more preferably from about 100 angstroms to about 200 angstroms for an optimum combination of electrical conductivity, flexibility and light transmission. The flexible conductive layer may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Melinex available from E.I. du Pont de Nemours & Co. with magnetron sputtering.

If desired, an alloy of suitable metals may be deposited. Typical metal alloys may contain two or more metals such as zirconium, niobium, tantalum, vanadium, hafnium, titanium, nickel, stainless steel, chromium, tungsten, molybdenum, and the like, and mixtures thereof. A typical electrical conductivity for conductive layers for electrophotographic imaging members in slow speed copiers is about 102 to 103 ohms/square.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetatevinylidenechloride copolymers, styrenealkyd resins, polyvinylcarbazole, and the like. These polymers may be block, random or alternating copolymers.

The photogenerating composition or pigment is present in the resinous binder composition in various amounts, generally, however, from about 5 percent to about 90 percent, by volume, of the photogenerating pigment is dispersed in about 10 percent to about 95 percent, by volume, of the resinous binder. Preferably, from about 20 percent to about 30 percent, by volume, of the photogenerating pigment is dispersed in about 70 percent to about 80 percent, by volume, of the resinous binder composition. In one embodiment about 8 percent, by volume, of the photogenerating pigment is dispersed in about 92 percent, by volume, of the resinous binder composition. The photogenerator layers can also be fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer has to be fabricated in a dot or line pattern. Solvent removal for a solvent coated layer may be effected by any suitable conventional technique such as oven drying, infra red radiation drying, air drying and the like.

The heterogeneous, particle-contact, charge-transport layer is fabricated from dispersions of microcrystalline pigments in suitable binders. The microcrystalline pigments that can be employed include: metal free phthalocyanines, metal phthalocyanines such as, oxyvanadium phthalocyanine, chloroaluminum phthalocyanine, copper phthalocyanine, oxytitanium phthalocyanine, chlorogallium phthalocyanine, magnesium phthalocyanine, and the like. The phthalocyanines exist in many crystal forms and any crystal form can be employed. Other microcrystalline materials that can be employed include organic materials such as perylenes, perinones, squaraines, azo-type pigments and the like and inorganic materials such as zinc oxide, cadmium sulfide, cadmium selenide, cadmium sulfoselenide, trigonal selenium and the like, and electron transport materials such as alkyl substituted diphenoquinines and the like. Typical organic polymeric film forming binders that can be employed include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinyl acetate vinylidene chloride copolymers, styrene-alkyd resins, polyvinylcarbazole, polysilylenes and the like. These polymers may be block, random or alternating copolymers. The pigment to binder ratio should be adjusted to a value close that required to maintain particle contact. It is preferable that the crystallites have an asymmetric shape, that is be more needle like. Performance is not adversely affected by having a very thin layer of organic binder between the crystals provided the charge can jump the gap with negligible trapping. Depending on the shape of the crystallites, the percent pigment can vary from about 10 to about 70 percent, by volume. Too small a volume concentration leads to thick layers of inactive binder between pigment particles leading to charge trapping and unacceptable residual potentials. Too high a volume concentration may soften or destroy the S shaped discharge or lead to high dark decay. The preferred pigment concentration range is from about 10 to 40 percent, by volume.

Any suitable and conventional technique may be utilized to mix and thereafter apply the heterogeneous charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Another method of forming the heterogeneous, particle-contact, charge transport layer is by phase separating a charge transporting dye or molecules in a solid solution with an insulating binder by crystallization. While either or both phases may be crystallized, it is preferable from the mechanical properties to crystallize the smaller volume and nonpolymeric phase, which is usually the charge transporting phase.

The transport layers can also be fabricated from multi block copolymers containing charge transporting blocks separated by blocks of electrically inactive blocks. Multi block copolymers prepared by sequential free radical copolymerization of vinyl carbazole and dodecyl methacrylate described in U.S. Pat. No. 3,994,994 is an example of the type of block copolymers that can be employed. Block copolymers prepared by condensation including those described in U.S. Pat. Nos. 4,618,551, 4,806,443, 4,806,444, 4,818,650, 4,935,487, and 4,956,440 containing charge transporting aryl amine units with inactive blocks of low molecular weight polysiloxanes, aliphatic and aromatic polyesters, polyurethanes etc. can be employed.

Generally, the thickness of the heterogeneous charge transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. In other words, the charge transport layer, is substantially non-absorbing to visible light or radiation in the region of intended use. But, the charge transport layer is "active" in that it allows the injection of photogenerated holes from the photoconductive layer, i.e., charge generation layer. The charge transport layer also allows the holes to be transported through to selectively discharge any active layer surface charge.

Other layers may also be used such as conventional electrically conductive ground strip along one edge of the belt or drum in contact with the conductive layer to facilitate connection of the electrically conductive layer of the photoreceptor to ground or to an electrical bias, blocking layer, adhesive layer. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are conventional and may comprise thermoplastic organic polymers or inorganic polymers that are electrically insulating or slightly semiconducting. overcoatings are continuous and generally have a thickness of less than about 10 micrometers.

DETAILED DESCRIPTION OF THE INVENTION

Figure 3:
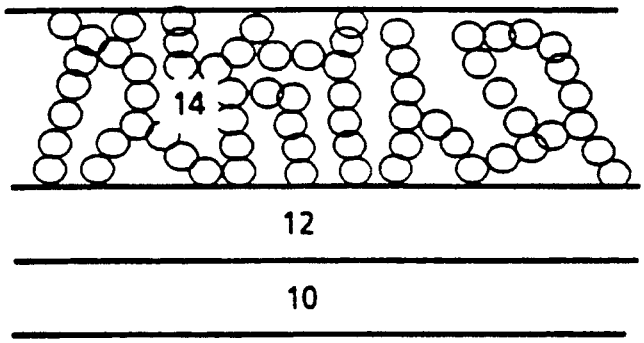
FIG. 3 illustrates an electrophotographic imaging member according to the present invention.

FIG. 3 schematically illustrates an electrophotographic photoreceptor 1 that includes a conductive substrate 10, a charge generator layer 12 that contacts the substrate 10, and a heterogeneous charge transport layer 14 with a structure in which charge transporting regions are intermixed with electrically inactive regions and the charge transporting regions are in contact with each other (hereinafter called charge transporting particle contact type transport layer).

Figure 4:
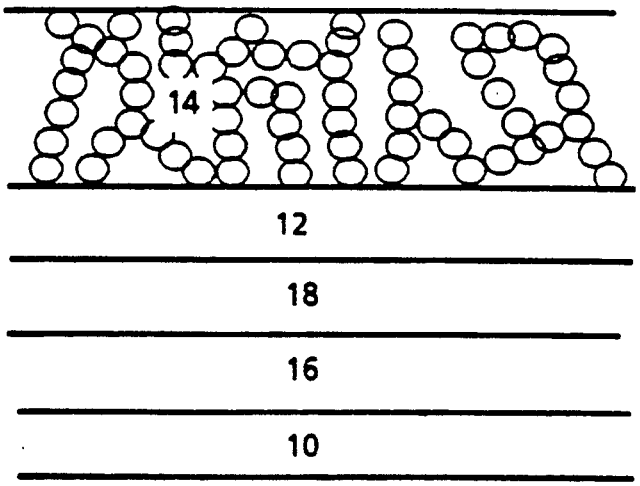
FIG. 4 illustrates an electrophotographic imaging member according to the present invention employing an adhesive and a barrier layer.

FIG. 4 schematically illustrates an electrophotographic photoreceptor 1 that includes a conductive substrate 10, a barrier layer 16, an adhesive layer 18, a charge generator layer 12 that contacts the adhesive layer 18, and a heterogeneous charge transporting particle contact type transport layer 14.

Figure 5:
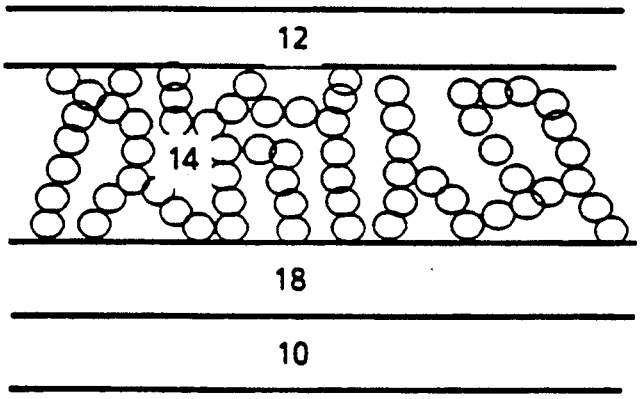
FIG. 5 illustrates an electrophotographic imaging member according to the present invention employing an inverted structure.

FIG. 5 schematically illustrates an electrophotographic photoreceptor 1 that includes a conductive substrate 10, an adhesive layer 18, a heterogeneous charge transporting particle contact type transport layer 14 and a charge generator layer 12. Examples are set forth herein below and is illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE 1

Preparation of Multi Block Copolymer of N-Vinylcarbazole and N-Dodecyl-Methacrylate The multi block copolymer of N-vinylcarbazole with n-dodecyl methacrylate (also called lauryl methacrylate) was prepared by a modified three step heterophase sequential free radical polymerization originally described in U.S. Pat. No. 3,994,994 (Nov. 30, 1976). (M. Stolka, Process for Preparation of Block Copolymers from Vinyl carbazoles and Other Addition Monomers). Specifically, n-dodecyl methacrylate was purified by extraction with saturated water solution of sodium carbonate containing approximately 2 wt. % of potassium hydroxide (based on the carbonate). The extraction was repeated six times until all color disappeared. The crude monomer was further purified by extraction with distilled water, until neutral reaction was reached, and dried by anhydrous magnesium sulphate. N-vinylcarbazole was recrystallized twice from methanol. Solvents (benzene and n-decane) were purified by column chromatography using activated neutral alumina. The bifunctional free radical initiator, di-[1,3-dimethyl-3(t.butylperoxy)butyl]-peroxydicarbonate was a research sample, supplied by Lucidol Co, labeled as R-S904. This initiator has two peroxy groups which undergo decomposition to free radicals at two different temperatures: The temperatures of ten hour lifetimes of this initiator are 47° C. and 127° C., respectively. The large difference in ten hour lifetimes enable using this type of initiator in sequential free radical block copolymerizations.

Polymerization step I. 29 g. of n-dodecyl methacrylate and 75 mL of benzene were placed in a three necked flask equipped with nitrogen gas inlet and outlet, and a mechanical stirrer. The temperature was raised to 52° C. and then, under the flow of nitrogen, 1 mL of the initiator was added. After 7 hours of polymerization, the polymer was isolated by precipitation in methanol. The residual monomer and initiator were removed by two reprecipitations of the product from benzene solutions into methanol. The yield of poly(n-dodecyl methacrylate) which was terminated with the remnants of the bifunctional initiator, was 27.5 g (95%). The weight average molecular weight of the polymer, determined by the combination of conventional light scattering and size exclusion chromatography methods, was $4\times10^5$, and the molecular weight distribution factor was 7.4.

Polymerization step II. 5.0 g. of the peroxy terminated poly(n-dodecylmethacrylate) from step 1, and 7.0 g N-vinylcarbazole were dispersed in 70 mL n-decane and the temperature was raised to 135° C. Shortly after this temperature was reached the mixture became a gel. The reaction was allowed to proceed for another 7 hours at the same temperature. Stirring was not possible due to the gelatineous nature of the mixture.

Polymerization stop III. The temperature was reduced to 65° C., and then 1.75 g of n-dodecyl methacrylate in 100 mL benzene was added to the above mixture. The gel quickly and completely dissolved and the homogeneous solution was stirred under nitrogen for another 16 hours at 65° C. The polymeric product was then isolated by precipitation in excess methanol and reprecipitated twice from benzene solution into methanol and dried in vacuum at 40° C.

The crude polymeric product containing 64.5 mole % of N-vinylcarbazole monomer units and 35.5 mole % of n-dodecyl methacrylate monomer units, as determined by IR analysis, was then extracted by hexane. The hexane soluble polymeric fraction (about 8 wt. % of the total) was rich on n-dodecyl methacrylate (82.6 mole %) and was discarded. Then, the remaining product was extracted with dimethyl formamide (DMF) to remove the N-vinylcarbazole-rich fraction. The DMF soluble polymeric fraction (about 16 wt. % of the total solids) contained 94.9 mole % N-vinylcarbazole and was discarded. The hexane insoluble, DMF insoluble fraction (76 wt. %) was a true block copolymer and contained 63.8 mole % N-vinylcarbazole monomer units and 36.2 mole % n-dodecyl methacrylate monomer units. The weight average molecular weight of this copolymer determined by the combination of light scattering and the size exclusion chromatography methods was $2.85\times10^6$ and the molecular weight distribution factor was 7.5. This copolymer is freely soluble in benzene, toluene, methylene chloride and tetrahydrofuran and forms colorless transparent films. Since the N-vinylcarbazole and n-dodecyl methacrylate blocks are structurally and compositionally different, it is expected that these blocks will exhibit strong phase separation, i.e. the N-vinylcarbazole blocks will tend to agglomerate into domains which are linked together by the n-dodecyl methacrylate blocks, thus essentially forming quasi particulate composition, where the Nvinylcarbazole domains constitute charge transporting regions and the n-dodecyl methacrylate domains constitute the electrically inactive regions.

EXAMPLE 2

A photoreceptor is prepared by forming coatings using conventional techniques on a substrate comprising a vacuum deposited titanium layer on a polyethylene terephthalate film (Melinex~, available from E. I. dupont de Nemours & Co.). The first deposited coating is a siloxane barrier layer formed from hydrolyzed gamma aminopropyl triethoxy silane having a thickness of 100 angstroms. The second coating is an adhesive layer of polyester resin (PE 49,0000®, available from E. I. dupont de Nemours & Co.) having a thickness of .50 angstroms. The next coating is a 0.5 micrometer thick charge generator layer of amorphous selenium. Amorphous selenium layer is formed by conventional vacuum deposition technique such as those disclosed by Bixby in U.S. Pat. No. 2,753,278 and U.S. Pat. No. 2,970,906. A charge transport layer is prepared by dissolving in 135 grams of methylene chloride and 3.34 grams of the block copolymer described in Example 1. A layer of the above mixture is formed on the amorphous selenium layer using a Bird Film Applicator. The coating is then vacuum dried at 40° C. for 18 hours to form a 22 micrometer thick film. The device is mounted on a cylindrical aluminum drum which is rotated on a shaft. The device is charged by a corotron mounted along the periphery of the drum. The surface potential is measured as a function of time by capacitively coupled voltage probes placed at different locations around the shaft. The probes are calibrated by applying known potentials to the drum substrate. The devices on the drums are exposed by a light source located at a position near the drum downstream from the corotron.

Charging of the photoconductor devices is accomplished by a corotron. As the drum is rotated, the initial (pre exposure) charging potential is measured by voltage probe 1. Further rotation leads to the exposure station, where the photoconductor device is exposed to monochromatic radiation of known intensity. The device is erased by light source located at a position prior to charging. The measurement consists of charging the photoconductor device in a constant current or voltage mode. The device is charged to a negative polarity corona. As the drum is rotated, the initial charging potential is measured by voltage probe 1. Further rotation leads to the exposure station, where the photoconductor device is exposed to monochromatic radiation of known intensity. The surface potential after exposure is measured by voltage probes 2 and 3. The device is finally exposed to an erase lamp of appropriate intensity and any residual potential is measured by voltage probe 4. The process is repeated with the magnitude of the exposure automatically changed during the next cycle. The photodischarge characteristics is obtained by plotting the potentials at voltage probes 2 and 3 as a function of light exposure. The photodischarge curve has an S shape indicating that that the charge transport layer is a heterogeneous, particle contact type.

EXAMPLE 3

A photoreceptor is prepared by forming coatings using conventional techniques on a substrate comprising a vacuum deposited titanium layer on a polyethylene terephthalate film (Melinex~, available from E.I. dupont de Nemours & Co.). The first deposited coating is an adhesive layer of polyester resin (PE 49,000~, available from E.I. dupont de Nemours & Co.) having a thickness of 50 angstroms. The next coating is a heterogeneous charge transport layer containing 35 percent by weight vanadyl phthalocyanine particles obtained by the process as disclosed in U.S. Pat. No. 4,771,133 to Liebermann et al., issued Sep. 13, 1988, dispersed in a polyester resin (Vitel PE100, available from Goodyear Tire and Rubber Co.) having a thickness of 10 micrometer. The next layer is a charge generation layer 0.5 micrometers thick of amorphous selenium, vacuum deposited by the technique referenced in Example 2. The device is charged to a positive polarity by corona in the drum scanner described in Example 2. The photodischarge curve, obtained using a blue wavelength light entirely absorbed by the selenium layer, has an S shape indicating that while the charge is generated in the charge generation layer, the discharge shape is due to the heterogeneous charge transport layer.

EXAMPLE 4

A photoreceptor is prepared as in Example 3, except the charge generation layer consists of a vacuum deposited amorphous $As_2Se_3$. The device is charged to a positive polarity by corona in the drum scanner described in Example 2. The photodischarge curve, obtained using a blue to red wavelength light entirely absorbed by the amorphous $As_2Se_3$ layer, has an S shape indicating that while the charge is generated in the charge generation layer, the discharge shape is due to the heterogeneous charge transport layer.

EXAMPLE 5

A photoreceptor is prepared by coating a thin sheet of oxidized aluminum with a charge generator layer containing 35 percent by weight vanadyl phthalocyanine particles obtained by the process as disclosed in U.S. Pat. No. 4,771,133 to Liebermann et al., issued Sep. 13, 1988, dispersed in a polyester resin (Vitel PE100, available from Goodyear Tire and Rubber Co.) having a thickness of 1 micrometer. This overcoated with a heterogeneous charge transport layer 15 micrometers thick consisting of a two phase aggregate photoconductor containing a co-crystalline phase of a thiopyrilium dye and a polycarbonate polymer in an amorphous phase of triphenylmethane in polycarbonate. This layer is prepared, coated and phase separated by solvent induced crystallization as described by "An aggregate Organic Photoconductor Part ill Dullmage et al. and published in the Journal of Applied Physics, vol 4, page 5555, 1978. The device is charged to a positive polarity by corona in the drum scanner described in Example 2. The photodischarge curve, obtained using an infrared wavelength light of 800nm entirely absorbed by the vanadyl phthalocyanine layer, has an S shape indicating that while the charge is generated in the charge generation layer, the discharge shape is due to the heterogeneous charge transport layer.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a conductive substrate;

a charge generating layer; and a charge transport layer; said charge transport layer comprising at least two charge transporting regions and an electrically inactive region, said charge transporting regions in contact with each other forming a convoluted charge transport path.

2. An electrophotographic imaging member according to claim 1 wherein the charge transporting regions consists of particles of inorganic photoconducting materials.

3. An electrophotographic imaging member according to claim 1 wherein the charge transporting regions consists of microcrystalline particles of organic pigments.

4. An electrophotographic imaging member according to claim 1 wherein the charge transporting regions consists of microcrystalline particles of organic charge transporting material.

5. An electrophotographic imaging member according to claim 1 wherein the charge transporting regions consists of regions of organic charge transporting material.

6. An electrophotographic imaging member according to claim 5 wherein the charge transport layer is fabricated from an organic block copolymer consisting of charge transporting blocks that are separated by electrically inactive blocks.

7. An electrophotographic imaging member according to claim 6 in which the charge transporting blocks form regions of charge transport which are in contact with each other.

8. An electrophotographic imaging member according to claim 1 wherein the charge transporting regions have linear dimensions of between 0.0015 micrometers to 5 micrometers.

9. An electrophotographic imaging member according to claim 2 wherein the inorganic charge transporting particles are zinc oxide crystallites.

10. An electrophotographic imaging member according to claim 2 wherein the inorganic charge transporting particles are cadmium sulphide crystallites.

11. An electrophotographic imaging member according to claim 3 wherein the organic charge transporting particles are phthalocyanine pigment crystallites.

12. An electrophotographic imaging member according to claim 3 wherein the organic charge transporting particles are perylene-based pigment crystallites.

13. An electrophotographic imaging member according to claim 3 wherein the organic charge transporting particles are perinone-based pigment crystallites.

14. An electrophotographic imaging member according to claim 4 wherein the organic charge transporting particles are crystallites of aryl amine, electron donor molecules.

15. An electrophotographic imaging member according to claim 4 wherein the organic charge transporting particles are crystallites of electron transport molecules.

16. An electrophotographic imaging member according to claim 6 wherein the charge transporting block of the organic charge transporting block copolymer is selected from the group consisting of Poly N vinyl carbazole, polyaryl amines and polysilylenes.

17. An electrophotographic imaging member according to claim 6 wherein the electrically inactive block of the organic charge transporting block copolymer is selected from the group consisting poly methyl methacrylates, polycarbonates and polystyrene.

18. An electrophotographic imaging member according to claim 1 wherein the charge generation layer is interposed between the substrate and the charge transport layer.

19. An electrophotographic imaging member according to claim 1 wherein the charge transport layer is interposed between the substrate and the charge generation layer.

20. An electrophotographic imaging member according to claim 1 wherein said charge generator layer has a thickness of between about 0.05 micrometer and about 5 micrometers.

21. An electrophotographic imaging member according to claim 1 wherein said charge transport layer has a thickness of between about 5 micrometers and about 50 micrometers.

22. An electrophotographic imaging member according to claim 1 wherein the charge generating pigment in the charge generating layer is dispersed in a resinous binder in an amount of between about 5 percent by weight and about 95 percent by weight based on the total weight of said charge generating layer.

23. An electrophotographic imaging member according to claim 1 wherein the charge layer is vacuum deposited.

24. An electrophotographic imaging member according to claim 1 wherein the substrate is comprised of a drum.

25. An electrophotographic imaging member according to claim 1 wherein the substrate is a flexible belt.

26. An electrophotographic imaging member according to claim 1 wherein the substrate is a flexible belt with a transparent conductive coating and the said supporting substrate is transparent.

27. An imaging process comprising providing an electrophotographic imaging member comprising a charge generating layer and a charge transport layer, said charge transport layer comprising charge transporting regions and electrically inactive regions, said charge transporting regions in contact with each other, depositing a uniform electrostatic charge on said imaging member with a corona charging device, exposing said imaging member to a light image pattern to form an electrostatic latent image on said imaging member, developing said electrostatic latent image with electrostatically attractable marking particles to form a visible toner image, transferring said toner image to a receiving member and repeating said depositing, exposing, developing and transferring steps.

28. A charge transport material for use in an electrophotographic imaging system comprising:

a plurality of charge transporting regions; and an electrically inactive region, said charge transporting regions comprising a convoluted charge transport path.

* * * * *

UNITED STATES PATENT AND TRADEMARK OFFICE

CERTIFICATE OF CORRECTION

PATENT NO. : 5,306,586

DATED : April 26, 1994

INVENTOR(S) : Damodar M. Pai, et al.

It is certified that error appears in the above-indentified patent and that said Letters Patent is hereby corrected as shown below:

| Column | Line | |
|---|---|---|
| 9 | 13 | Change "over-" to -- Over- --. |
| 9 | 50 | Change "N-Dodecyl" to --n-Dodecyl--. |
| 11 | 21 | Change "dupont" to --duPont--. |
| 11 | 22 | change ".50" to --50--. |
| 12 | 7 | Change "dupont" to --duPont--. |
| 12 | 9 | Change "dupont" to --duPont--. |
| 12 | 56 | Change "Part ill" to --Part 1"--. |

Signed and Sealed this

Twenty-seventh Day of September, 1994

*Attest:*

Bruce Lehman

BRUCE LEHMAN

*Attesting Officer*

*Commissioner of Patents and Trademarks*